United States Patent [19]

Kimzey et al.

[11] 4,373,227

[45] Feb. 15, 1983

[54] SURFACE MAINTENANCE EQUIPMENT

[75] Inventors: Paul W. Kimzey, St. Louis Park; Sherman B. Frederick, New Hope, both of Minn.

[73] Assignee: Tennant Company, Minneapolis, Minn.

[21] Appl. No.: 185,879

[22] Filed: Sep. 9, 1980

[51] Int. Cl.[3] ..... E01H 1/08

[52] U.S. Cl. ..... 15/347; 15/340; 55/304

[58] Field of Search ..... 15/340, 347, 349, 352; 55/304

[56] References Cited

U.S. PATENT DOCUMENTS

| | | | |
|---|---|---|---|
| 1,560,612 | 11/1925 | Sims | 15/340 X |
| 3,540,073 | 11/1970 | Issenmann et al. | 15/352 X |
| 3,585,788 | 6/1971 | Wilson | 55/487 X |
| 3,639,940 | 2/1972 | Carlson et al. | 15/352 |
| 4,006,511 | 2/1977 | Larsen | 15/340 X |
| 4,206,530 | 6/1980 | Kroll et al. | 15/340 |

*Primary Examiner*—Chris K. Moore

*Attorney, Agent, or Firm*—Merchant, Gould, Smith, Edell, Welter & Schmidt

[57] ABSTRACT

Surface maintenance equipment is disclosed including mechanism for moving an airstream therethrough and a filtering device for cleaning the airstream prior to discharge into the atmosphere. The filtering device includes a conventional filter and a screen. The screen removes larger airborne pieces such as grass clippings.

8 Claims, 2 Drawing Figures

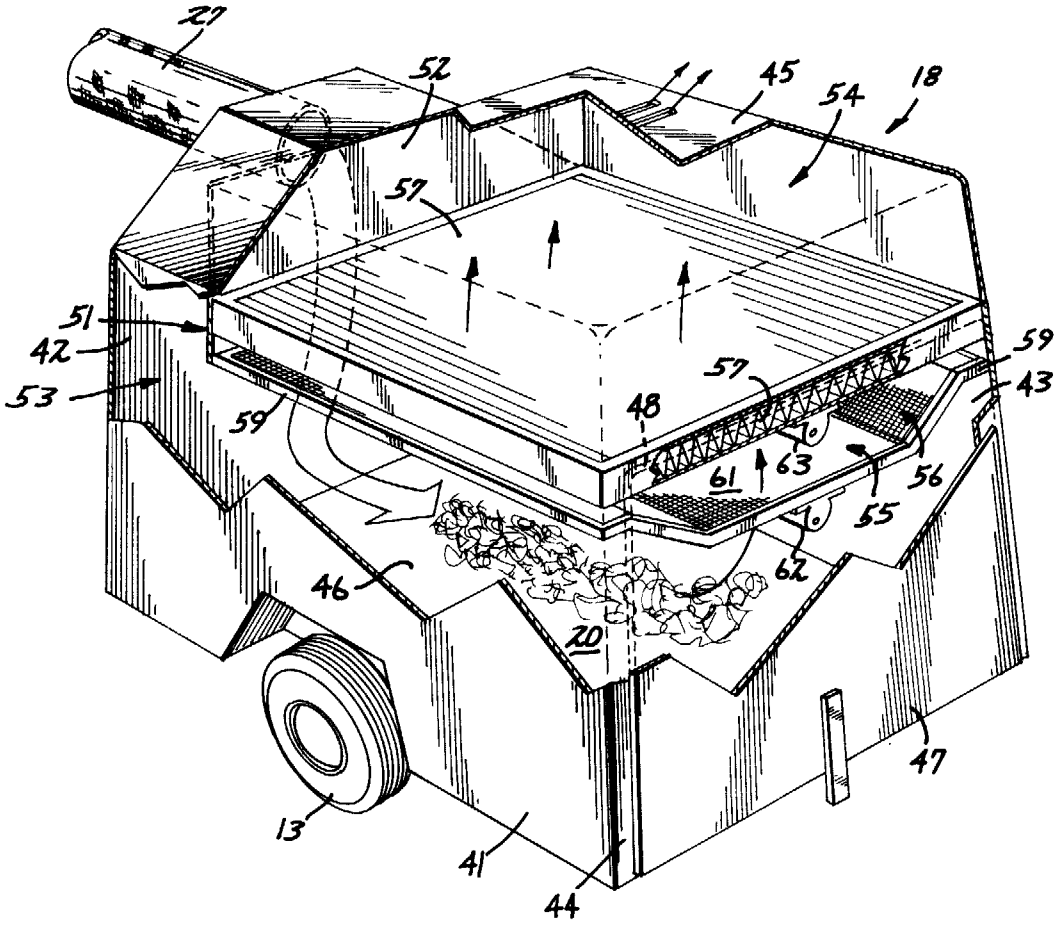
FIG. II

SURFACE MAINTENANCE EQUIPMENT

TECHNICAL FIELD

Technical field of the present invention relates to surface maintenance equipment such as lawn sweepers and more particularly to surface maintenance equipment including mechanism for prevention of blinding of the filter by lightweight debris which is easily airborne such as grass clippings, lint, and the like.

BACKGROUND OF THE INVENTION

Surface maintenance equipment is available in a wide variety of types and sizes. Some of such equipment is designed for indoor use while other is particularly adapted for use in caring for large outdoor areas such as parks, cemeteries, large lawns and parking lots. The present invention is generally of the latter type although it is suitable for use in other environments, e.g. clothing factories.

Surface maintenance equipment in the past has typically included a body portion which is supported on a plurality of wheels. Some of the wheels may be driven by a power source such as a gasoline engine or electric motor. The body portion will usually carry a hopper for containment of dirt and debris which has been picked up. In some instances the equipment may be articulated and include a cab portion and a trailer portion. The equipment will generally include a debris pickup housing which defines a zone from which the grass clippings, dirt and debris are lifted and deposited into the hopper. A rotatably driven cylindrical tool such as a brush or paddle structure may be disposed in the pickup housing to assist in lifting the grass clippings, dirt, and debris. A duct may provide communication between the debris pickup housing and the hopper. A pump or blower may vacuumize the debris pickup housing and the ducts to assist in lifting and transporting debris material. Surface maintenance equipment of course includes various controls such as steering mechanism, speed controls and the like. The general type of equipment contemplated in the present invention is illustrated in U.S. Pat. Nos. 3,837,038 (Kimzey) and 3,881,215 (Krier) which are assigned to the Tennant Company.

Surface maintenance equipment used in areas having lightweight debris such as grass clippings encounters some somewhat unique problems. In particular it has been found that grass clippings and the like may remain airborne in the hopper such that they accumulate on the surface of the filter which cleans the air being expelled to the atmosphere. It has been known in the past to vibrate a filter such as a panel or bag filter to displace accumulated dust and dirt particles. Such approach is not completely satisfactory when the accumulated debris is materials such as grass clippings or lint. In other words, such material is not easily dislodged from the filter and the filter becomes blinded, thus reducing the effectiveness of the vacuum system. The present invention overcomes such problems by provision of a secondary screening system which removes the grass clippings, lint, and the like prior to the air approaching the filter.

SUMMARY OF THE INVENTION

The present invention relates to equipment for the sweeping of outdoor areas such as lawns, parks, cemeteries and parking lots. The present surface maintenance equipment may include a motorized body structure which is supported on a plurality of wheels. The equipment has a debris pickup housing and duct work extending from the housing to a storage area or hopper. A rotatable tool such as a brush or paddle cylinder may be provided in the debris pickup housing to assist in lifting the debris into the duct and ultimately into the storage area. A vacuumized and/or pressurized airstream serves to assist in carrying the debris. A lip-like seal or skirt may be provided around the lower edge of the debris pickup housing. The present equipment includes mechanism for cleaning the airstream prior to release into the atmosphere. The mechanism for cleaning the air may include a conventional filter, for example a panel filter. The mechanism for vacuumizing the airstream may be disposed upstream or downstream of the mechanism for cleaning the air. Disposed upstream of the filter is a screen structure for removing larger airborne debris such as grass clippings and the like. The screen structure may include a vibratory mechanism for periodically dislodging the grass clippings and other debris from the upstream side of the screen.

BRIEF DESCRIPTION OF THE DRAWINGS

In the drawings:

FIG. I is a left side view of surface maintenance equipment according to the present invention;

Figure 1:
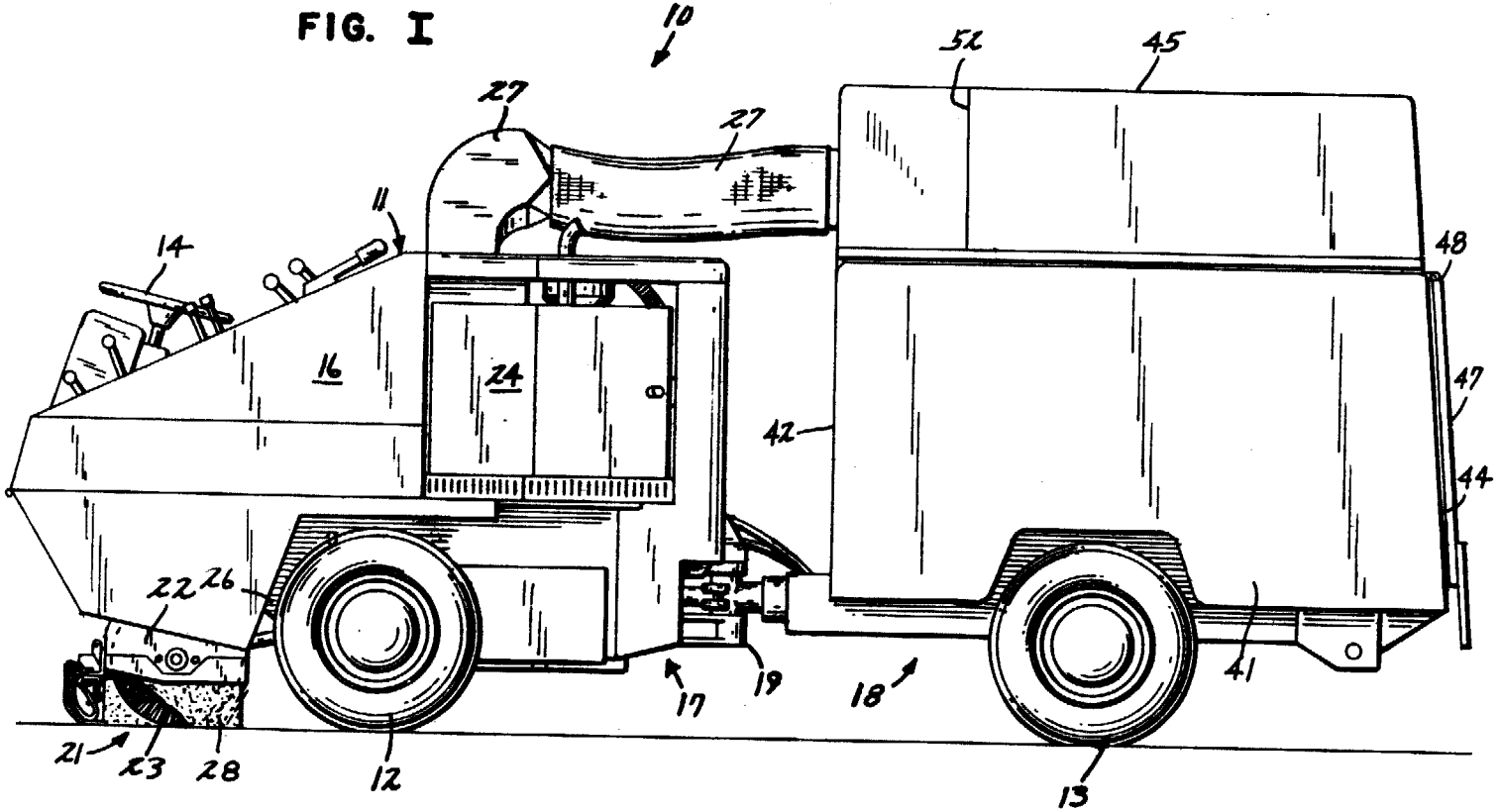

FIG. II is a side perspective view of the hopper portion of the present invention with a section broken away to disclose underlying structure.

DETAILED DESCRIPTION OF THE PRESENT INVENTION

The surface maintenance equipment 10 of the present invention, one embodiment of which is illustrated in FIGS. I and II, may include a body structure 11 which is supported on a plurality of wheels 12 and 13. Wheels 12 may be steerable such as by a suitable movement of the steering wheel 14 to control the direction traversed by the equipment 10. The wheels 12 may also be driven by suitable motor or engine 16. In the particular equipment shown in FIG. I the unit includes a tractor portion 17 and a trailer 18, which are interconnected by a trunion joint 19. Equipment 10 has a pickup assembly 21 including a housing 22 and a rotatably driven pickup tool 23. The pickup housing 22 may be connected to a fan 24 by a duct 26. The fan 24 may in turn be connected to the trailer 18 by the duct 27.

The pickup housing 22 may include a metal-walled structure which is downwardly opening and has a plurality of resilient lips or skirts such as 28 around the periphery thereof. The skirts 28 provide a partial seal between the housing 22 and the surface being cleaned. The skirts 28 permit sufficient spacing between the metal parts of housing 22 and the surface being swept to allow passage of larger pieces of debris therebeneath. The rotary tool 23 may be a paddle structure as shown in commonly assigned U.S. Pat. No. 3,837,038 or it may be a cylindrical bristle brush structure. The rotary tool 23 may be driven by the motor 16 through a chain and sprocket arrangement. Alternatively the tool 23 may be directly driven by a motor. The fan 24 may vacuumize the housing 22 and duct 26 to lift debris which is lying on the surface over which the housing 22 passes. The fan further serves to project the debris through the duct 27 and into the lower portion of the hopper 20 provided by trailer 18 using a positive pressure air flow.

The trailer 18 may include four side walls 41, 42, 43, and 44 and a top 45 which are supported on a base or floor portion 46. The wall, floor, and top structure may be of sheet metal or resinous (e.g. plastic) sheet material. The top 45 may have louvered openings through which filtered air may be dispelled into the atmosphere. The rear wall 44 includes a door structure 47 which is hinged along the upper edge 48. The door 47 may be provided with a suitable seal around the edge thereof and a latch system.

The trailer 18 includes a filtering section 51 which is supported adjacent the upper edge of the walls 41-44. The support portions of filter section 51 may be bolted to the side walls or may be welded thereto. The filtering section 51 includes a forward wall 52 which is disposed spaced from the exit of duct 27 into the hopper 20. The filtering section 51 includes a screen assembly 56. Thus the hopper 20 includes a first zone 53 into which unfiltered air and debris are propelled. The hopper 20 further includes a second zone 55 between screen assembly 56 and filter 57 into which dust-laden air may pass and a third zone 54 into which filtered air is fed from the zone 55.

The screen structure 56 may include a frame 59 which supports a single or a plurality of screen sections 61. The screens 61 are selected of a porosity that will permit fine debris such as fine particles of dirt to pass therethrough but will trap larger materials such as grass clippings and the like. One preferred embodiment has screen openings which are 0.03 inches square. The screen structure 56 may be supported in a track along each edge thereof with the track being supported by the side walls of the trailer 18. It is desirable that the screen structure 56 may be readily removed such as for thorough cleaning thereof and replacement of the screen section or sections with screen of various selected porosity. For example, one may wish to hose the screen structure with water from time to time.

The screen assembly 56 may include a vibration imparting device such as an unbalanced centrifugal device 62 which is electrically powered for vibrating the screen structure 56 thereby periodically dislodging the accumulated grass clippings, dirt and the like from time to time. The trailer 18 may be designed for dumping by tilting the trailer 18. The accumulated debris in zones 53 and 55 will then be dumped rearwardly. The particular configuration of screen structure 56 facilitates ready dumping.

The filtering assembly 51 further includes a panel filter 57 which may likewise be supported in suitable track mechanism in the side walls of the trailer 18. The filter 57 may be of a conventional structure and may include a mechanism 63 for vibration thereof to dislodge accumulated debris from the surface thereof. The airstream through the hopper 20 is preferably halted during cleaning of filter assembly 51. The filter 57 may be of the type illustrated in U.S. Pat. No. 4,032,307.

Of course, various modifications may be made without departing from the broader scope of the present invention. For example, the fan may be located upstream or downstream from the filtering assembly. The unit may be a walk behind unit, for example, where the wheels are not power driven.

What is claimed is:

1. Surface maintenance equipment comprising a body structure supported on a plurality of wheels, a downwardly opening housing defining a pickup chamber, means for storage of dirt and debris, means for moving an airstream through said equipment to assist in transporting debris from said pickup chamber to said storage means, and a filtering assembly for cleaning said airstream before discharge, said filtering assembly including a first screen filter for removing larger airborne debris and a second filter for removing fine dust particles from said airstream, said first screen filter including vibration imparting mechanism for dislodgement of said larger debris and said second filter including vibration imparting mechanism for dislodgement of dirt and debris therefrom.

2. The surface maintenance equipment of claim 1 wherein said first screen filter comprises a screen assembly including a frame and screen sheet material supported in said frame, said screen sheet material being of a porosity sufficient to remove grass clippings.

3. The surface maintenance equipment of claim 2 wherein said vibration imparting mechanism comprises an unbalanced device rotatably driven.

4. The surface maintenance equipment of claim 3 wherein said means for moving the airstream is disposed upstream of said filtering assembly.

5. The surface maintenance equipment of claim 3 wherein said means for moving the airstream is disposed downstream of said filtering assembly.

6. The surface maintenance equipment of claim 3 further comprising power means for driving said wheels.

7. The surface maintenance equipment of claim 2, wherein said vibration imparting mechanism periodically dislodges accumulated dirt and debris.

8. Surface maintenance equipment comprising a body structure supported on a plurality of wheels, a downwardly opening housing defining a pickup chamber, means for storage of dirt and debris, means for moving an airstream through said equipment to assist in transporting dirt and debris from said pickup chamber to said storage means, and a filtering assembly for cleaning said airstream before discharge, said filtering assembly including a screen filter structure for removing larger airborne debris and permit fine particles to pass therethrough, said screen filter structure having a vibration imparting mechanism for dislodging said larger airborne debris from said screen structure, said filtering assembly further including a second filter for removing fine dust particles, said second filter having a vibration imparting mechanism for dislodging accumulated dirt and debris from said filter.

* * * * *